US011585242B2

(12) United States Patent
Ertl et al.

(10) Patent No.: US 11,585,242 B2
(45) Date of Patent: Feb. 21, 2023

(54) GAS TURBINE COMPONENT

(71) Applicant: MTU Aero Engines AG, Munich (DE)

(72) Inventors: Franz-Josef Ertl, Munich (DE); Hans-Peter Hackenberg, Olching (DE); Alexander Buck, Munich (DE); Oskar Ostermeir, Kottgeisering (DE)

(73) Assignee: MTU Aero Engines AG, Munich (DE)

( * ) Notice: Subject to any disclaimer, the term of this patent is extended or adjusted under 35 U.S.C. 154(b) by 0 days.

(21) Appl. No.: 17/207,782

(22) Filed: Mar. 22, 2021

(65) Prior Publication Data

US 2021/0301681 A1 Sep. 30, 2021

(30) Foreign Application Priority Data

Mar. 25, 2020 (DE) ..... 102020203840.6

(51) Int. Cl.
*F01D 25/24* (2006.01)
*F01D 9/04* (2006.01)

(52) U.S. Cl.
CPC ..... *F01D 25/246* (2013.01); *F01D 9/04* (2013.01); *F05D 2220/323* (2013.01); *F05D 2230/642* (2013.01); *F05D 2240/12* (2013.01); *F05D 2260/30* (2013.01)

(58) Field of Classification Search
CPC ..... F01D 25/246; F01D 9/04; F01D 9/041; F01D 11/001; F05D 2220/323; F05D 2230/642; F05D 2240/12; F05D 2260/30; F05D 2220/32; F05D 2230/64
USPC ..... 415/139
See application file for complete search history.

(56) References Cited

U.S. PATENT DOCUMENTS

| | | | | |
|---|---|---|---|---|
| 4,176,433 | A | 12/1979 | Lee et al. | |
| 6,752,591 | B2 | 6/2004 | Hain | |
| 8,070,445 | B2 | 12/2011 | Blanchard et al. | |
| 8,794,911 | B2 | 8/2014 | Murphy et al. | |
| 2003/0021689 | A1* | 1/2003 | Hain | F01D 9/04 416/204 R |
| 2011/0206504 | A1 | 8/2011 | Blanchard et al. | |
| 2011/0243722 | A1* | 10/2011 | Murphy | F01D 25/246 29/889.7 |
| 2014/0044537 | A1 | 2/2014 | Hackenberg | |
| 2017/0241279 | A1 | 8/2017 | Schlemmer et al. | |
| 2022/0251960 | A1* | 8/2022 | Edwards | F01D 9/04 |

FOREIGN PATENT DOCUMENTS

| | | | |
|---|---|---|---|
| DE | 100 37 837 | A1 | 3/2002 |
| EP | 1918512 | A2 | 5/2008 |
| EP | 2360352 | A2 | 8/2011 |
| EP | 2 696 039 | A1 | 2/2014 |
| EP | 3015657 | A1 | 5/2016 |
| WO | WO0212680 | A1 | 2/2002 |

* cited by examiner

*Primary Examiner* — Yi-Kai Wang
(74) *Attorney, Agent, or Firm* — Davidson, Davidson & Kappel, LLC

(57) ABSTRACT

A gas turbine component, in particular a stator vane cluster (10), having at least one radial flange (12, 13) with a radial slot (20) for spoke-type centering of a gas turbine element, in particular an inner ring (100), the radial slot (20) having a first slot flank (21), a slot base (23) adjoining the same, and a second slot flank (22) adjoining the same, the slot base (23) being asymmetric with respect to a mid-plane (M) which extends radially and perpendicularly to the circumferential direction and centrally between the two slot flanks (21, 22).

20 Claims, 1 Drawing Sheet

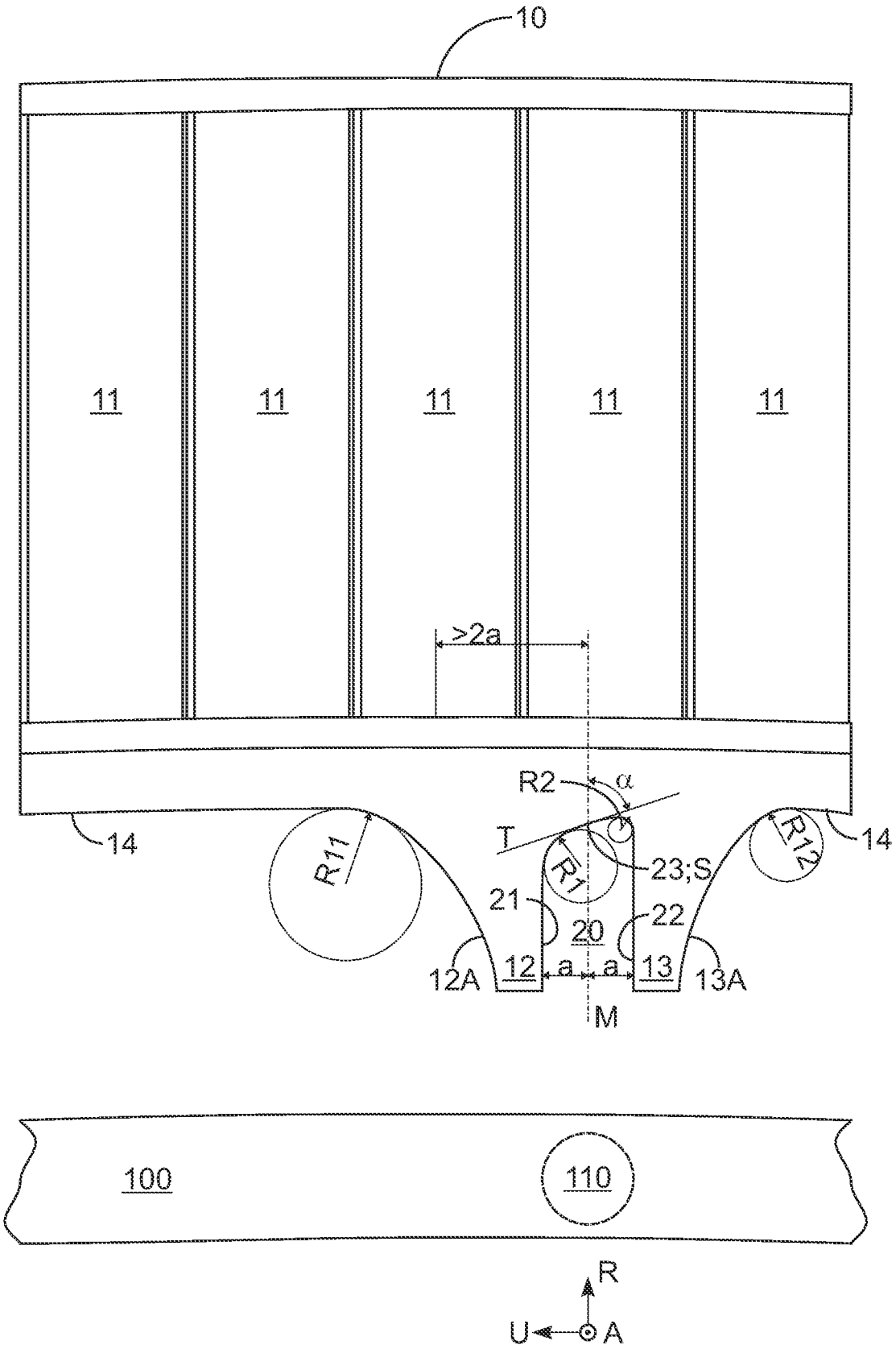
10
11
11
11
11
11
>2a
R2
α
T
14
R11
R1
23;S
R12
14
21
20
22
12A
12
a
a
13
13A
M
100
110
R
U
A

GAS TURBINE COMPONENT

This claims the benefit of German Patent Application DE 102020203840.6, filed Mar. 25, 2020 which is hereby incorporated by reference herein.

The present invention relates to a gas turbine component, in particular a stator vane cluster, having at least one radial flange with a radial slot for spoke-type centering of a gas turbine element, in particular an inner ring, as well as a gas turbine subassembly, and a gas turbine having the gas turbine component.

SUMMARY OF THE INVENTION

From in-house practice, there are known arrangements for spoke-type centering of inner rings to stator vane clusters of gas turbines, where pins of the inner rings engage in radial slots of radial flanges of the stator vane clusters. The present invention is particularly suitable for such spoke-type centering arrangements, but not limited thereto. Rather, it can also be used to advantage for other arrangements for spoke centering of gas turbine components and elements.

It is an object of one embodiment of the present invention to improve an arrangement for spoke-type centering of gas turbine components.

The present invention provides a gas turbine component. The present invention also provides a gas turbine subassembly having at least one gas turbine component as described herein, and for a gas turbine having at least one gas turbine component as described herein, in particular having at least one gas turbine subassembly as described herein. Advantageous embodiments of the invention are the subject matter of the dependent claims.

In accordance with one embodiment of the present invention, a gas turbine component has at least one radial flange with a radial slot that is intended, in particular adapted, or used for spoke-type centering of a gas turbine element. Accordingly, in one embodiment, a pin of the gas turbine element engages in the radial slot, in one embodiment form-fittingly and/or axially. In one embodiment, the pins extends through the slot, in particular axially.

In an embodiment, the term "axial," as used herein, refers to a direction parallel to an axis of rotation or (main) machine axis of the gas turbine, a circumferential direction is accordingly a direction of rotation or circumferential direction about this axis of rotation or (main) machine axis of the gas turbine, and the term "radial" accordingly refers to a direction perpendicular to the axial and circumferential directions, in particular away from the axis of rotation or (main) machine axis of the gas turbine or a coordinate (axis) direction which perpendicularly intersects the axis of rotation or (main) machine axis of the gas turbine.

Thus, in one embodiment, the radial flange and the radial slot extend in the radial direction, and in one embodiment, the radial flange extends or projects radially inwardly from the gas turbine component, and/or the radial slot is (a) radially inwardly open (slot).

In one embodiment, the gas turbine component is of single-piece or multi-piece construction, and/or a stator vane cluster is configured to have one or more stator vanes arranged in succession in the circumferential direction, and/or the gas turbine element is of single-piece or multi-piece construction, and/or an inner ring is configured to have a seal for sealing against a rotor of the gas turbine ("inner air seal").

In accordance with one embodiment of the present invention, the radial slot has a first slot flank, a slot base adjoining the same (in the circumferential direction), and a second slot flank adjoining the same (in the circumferential direction). In one embodiment, the two slot flanks positionally secure the pin of the gas turbine element in the circumferential direction or serve for retention in the circumferential direction; i.e., circumferential retention, or are intended, in particular adapted, or used for this purpose. Accordingly, in one embodiment, the two slot flanks form stops in the circumferential direction and/or the slot base forms a stop in the radial direction.

In accordance with one embodiment of the present invention, the first and second slot flanks extend parallel to each other and/or define parallel planes (over portions thereof, over at least 60% or at least 70% of their radial length, or completely). This may be particularly advantageous for radial guidance and for spoke-type centering.

In accordance with one embodiment of the present invention, a slot width or a slot depth, in particular a mean, maximum or minimum slot depth, is at least equal to, or at least 1.5 times a distance, in particular a mean, maximum or minimum distance, in the circumferential direction between the first and second slot flanks. This may allow for radial guidance over a certain radial portion and may be particularly advantageous for spoke-type centering.

Additionally or alternatively, in accordance with one embodiment of the present invention, a slot width or a slot depth, in particular a mean, maximum or minimum slot depth, is at least three times or no more than 2.5 times a distance, in particular a mean, maximum or minimum distance, in the circumferential direction between the first and second slot flanks.

In accordance with one embodiment of the present invention, a mid-plane extends radially; i.e., in the radial direction, and perpendicularly to the circumferential direction and, in one embodiment, contains the axis of rotation or (main) machine axis of the gas turbine, as well as centrally between these two slot flanks, and in one embodiment such that the mid-plane has the same, in particular minimum, maximum and/or mean distance in the circumferential direction from (each of) the first and second slot flanks at least at one radial height, in one embodiment at a plurality of radial heights, in particular over at least one radial portion. In one embodiment, the first and/or second slot flank(s) have at least one plane portion, and the mid-plane has the same, in particular minimum, maximum and/or mean distance in the circumferential direction from the first and second slot flanks at least at one radial height of these plane portions.

In accordance with one embodiment of the present invention, the slot base is asymmetric (i.e., configured, in particular contoured, asymmetrically) with respect to this mid-plane, in particular (as viewed) in the circumferential direction or in at least one meridional section.

Thus, in one embodiment, it is possible to achieve an asymmetrical stress distribution in the gas turbine component, in particular in the radial flange thereof, and thus, in one embodiment, to reduce and/or advantageously distribute peak stresses.

In one embodiment, the radial slot is offset or disposed off-center (in the circumferential direction) from a middle of the gas turbine component, in one embodiment by at least an, in particular, minimum, maximum or mean slot width.

In one embodiment, this, in combination with the asymmetric slot base, makes it possible to achieve a particularly advantageous stress distribution, in particular stress reduction.

In one embodiment, a minimum radius of curvature of a transition region from the first slot flank into the slot base is greater than a minimum radius of curvature of a transition region from the slot base into the second slot flank, in one embodiment by at least 5%, in particular by at least 10%, in one embodiment by at least 15%. In one embodiment, the second slot flank is spaced in the circumferential direction further away from a middle of the gas turbine component (in the circumferential direction) than the first slot flank.

In one embodiment, such an asymmetry makes it possible to achieve a particularly advantageous stress distribution, in particular stress reduction.

Additionally or alternatively, in one embodiment, a transition region from the first slot flank into the slot base and/or a transition region from the slot base into the second slot flank (each) has a varying curvature, in particular a free-form contour.

In one embodiment, this makes it possible to achieve a particularly advantageous stress distribution, in particular stress reduction.

In one embodiment, at least one tangent (to the slot base) at a point of the slot base, in particular a point of intersection of the slot base with the mid-plane, forms an angle with the mid-plane, in particular in at least one meridional section, which angle is less than 90° and greater than 0°, in one embodiment no greater than 88°, in particular no greater than 85°, in one embodiment no greater than 80°, and/or at least 60°, in particular at least 70°, in one embodiment at least 75°.

In one embodiment, this makes it possible to achieve a particularly advantageous stress distribution, in particular stress reduction.

In one embodiment, the radial flange has a first outer flank adjacent to the first slot flank in the circumferential direction and a second outer flank adjacent to the second slot flank in the circumferential direction, each of the outer flanks merging into a circumferential surface of the gas turbine component. Thus, in one embodiment, the radial flange has two radial projections, in particular radially inwardly extending projections, which are arranged in succession in the circumferential direction and which each have or form one of the two outer flanks and one of the two slot flanks; i.e., in particular, a first radial projection having the first outer flank and the first slot flank as well as a second radial projection having the second outer flank and the second slot flank.

In one embodiment, a minimum radius of curvature of a transition region from the circumferential surface into the one, in one embodiment first, outer flank is greater than a minimum radius of curvature of a transition region from the other or second outer flank into the circumferential surface, in one embodiment by at least 5%, in particular by at least 10%, in one embodiment by at least 15%.

In one embodiment, this, in combination with the asymmetric slot base, makes it possible to achieve a particularly advantageous stress distribution, in particular stress reduction, and particularly advantageously if both the first slot flank and the first outer flange disposed adjacent thereto or on the same (first) projection have transition regions with greater minimum radii of curvature than the second slot flank and the second outer flange disposed adjacent thereto or on the same (second) projection.

Additionally or alternatively, in one embodiment, a or the transition region from the circumferential surface into the first outer flank and/or a or the transition region from the second outer flank into the circumferential surface (each) has a varying curvature, in particular a free-form contour.

In one embodiment, this makes it possible to achieve a particularly advantageous stress distribution, in particular stress reduction.

BRIEF DESCRIPTION OF THE DRAWINGS

Further advantageous refinements of the present invention will become apparent from the dependent claims and the following description of preferred embodiments. To this end, in partially schematic form, the only FIG. 1 shows a gas turbine subassembly having a gas turbine component according to an embodiment of the present invention.

DETAILED DESCRIPTION

FIG. 1 depicts a gas turbine subassembly having a gas turbine component according to an embodiment of the present invention in the form of a stator vane cluster 10 including a plurality of stator vanes 11 and a radial flange projecting radially inwardly (downwardly in FIG. 1) and having a radial slot 20 which is formed by two projections 12, 13 (projecting radially inwardly or downwardly in FIG. 1) and has a first slot flank 21, a slot base 23 adjoining the same, and a second slot flank 22 adjoining the same for spoke-type centering (of a pin 110) of a gas turbine element which is in the form of an inner ring 100 and which is shown in FIG. 1 in a position removed or spaced apart radially inwardly or downwardly for the purpose of illustration. In the assembled state, pin 110 engages in radial slot 20 for purposes of spoke-type centering.

In FIG. 1, axial direction (A), radial direction (R), and circumferential direction (U) are indicated by A, R, and U, respectively.

In FIG. 1, a mid-plane M is plotted as a dash-dot line. Mid-plane M extends radially (vertically in FIG. 1) and perpendicularly to the circumferential direction; i.e. vertically in and perpendicularly to the plane of the drawing of FIG. 1, and has the same distance "a" from the two slot flanks 21, 22 in the lower portion in FIG. 1, and thus extends centrally therebetween.

Radial slot 20 is offset in the circumferential direction from the middle of stator vane cluster 10 by more than one slot width 2·a, the second slot flank 22 being spaced in the circumferential direction further away from the middle of the stator vane cluster than the first slot flank 21.

A minimum radius of curvature R1 of a transition region from first slot flank 21 into slot base 23 has a varying curvature, in the exemplary embodiment a free-form contour, and is greater than a minimum radius of curvature R2 of a transition region from slot base 23 into second slot flank 22, this transition region from slot base 23 into second slot flank 22 also having a varying curvature, in the exemplary embodiment a free-form contour.

Similarly, a minimum radius of curvature R11 of a transition region from a radially inner circumferential surface 14 of the stator vane cluster into the a or the (first) outer flank 12A of first projection 12 has a varying curvature, in the exemplary embodiment a free-form contour, and is greater than a minimum radius of curvature R12 of a transition region from a or the (second) outer flank 13A of second projection 13 into circumferential surface 14, this transition region from second outer flank 13A into circumferential surface 14 also having a varying curvature, in the exemplary embodiment a free-form contour.

The tangent T, plotted in FIG. 1, at a point of intersection S of slot base 23 with mid-plane M forms an angle $\alpha$ less than 90° and greater than 0° with the mid-plane.

Accordingly, slot base 23 is asymmetric (configured asymmetrically) with respect to mid-plane M.

Although the above is a description of exemplary embodiments, it should be noted that many modifications are possible. It should also be appreciated that the exemplary embodiments are only examples, and are not intended to limit the scope, applicability, or configuration in any way. Rather, the foregoing detailed description will provide those skilled in the art with a convenient road map for implementing at least one exemplary embodiment, it being understood that various changes may be made in the function and arrangement of elements described without departing from the scope of protection as set forth in the appended claims or derived from combinations of features equivalent thereto.

LIST OF REFERENCE CHARACTERS

10 stator vane cluster (gas turbine component)
11 stator vane
12 (first) projection
12A first outer flank
13 (second) projection
13A second outer flank
14 circumferential surface
20 radial slot
21 first slot flank
22 second slot flank
23 slot base
100 inner ring (gas turbine element)
110 pin
M mid-plane
R1 minimum radius of curvature of the transition region from the first slot flank into the slot base
R2 minimum radius of curvature of the transition region from the slot base into the second slot flank
R11 minimum radius of curvature of the transition region from the circumferential surface into the first outer flank
R12 minimum radius of curvature of the transition region from the second outer flank into the circumferential surface
S point of intersection
T tangent
$\alpha$ angle

The invention claimed is:

1. A gas turbine component comprising:

at least one radial flange with a radial slot for spoke centering of a gas turbine element, the radial slot having a first slot flank, a slot base adjoining the first slot flank, and a second slot flank adjoining the slot base, the slot base being asymmetric with respect to a mid-plane extending radially and perpendicularly to a circumferential direction and centrally between the first and second slot flanks.

2. The gas turbine component as recited in claim 1 wherein the radial slot is offset in the circumferential direction from a middle of the gas turbine component by at least one slot width defined by a distance between the first and second flanks.

3. The gas turbine component as recited in claim 1 wherein the second slot flank is spaced in the circumferential direction further away from a middle of the gas turbine component than the first slot flank.

4. The gas turbine component as recited in claim 1 wherein a first minimum radius of curvature of a first transition region from the first slot flank into the slot base is greater than a second minimum radius of curvature of a second transition region from the slot base into the second slot flank.

5. The gas turbine component as recited in claim 4 wherein the first minimum radius of curvature is greater that the second minimum radius of curvature by at least 5%.

6. The gas turbine component as recited in claim 1 wherein a first transition region from the first slot flank into the slot base or a second transition region from the slot base into the second slot flank has a varying curvature.

7. The gas turbine component as recited in claim 1 wherein at least one tangent at a point of the slot base forms an angle less than 90° and greater than 0° with the mid-plane.

8. The gas turbine component as recited in claim 7 wherein the point is at an intersection of the slot base with the mid-plane.

9. The gas turbine component as recited in claim 1 wherein the radial flange has a first outer flank adjacent to the first slot flank in the circumferential direction and a second outer flank adjacent to the second slot flank in the circumferential direction, each of the first and second outer flanks merging into a circumferential surface of the gas turbine component.

10. The gas turbine component as recited in claim 9 wherein a first minimum radius of curvature of a first transition region from the circumferential surface into the first outer flank is different than a second minimum radius of curvature of a second transition region from the second outer flank into the circumferential surface.

11. The gas turbine component as recited in claim 10 wherein the minimum radius of curvature is greater than the second minimum radius of curvature.

12. The gas turbine component as recited in claim 9 wherein a first transition region from the circumferential surface into the first outer flank or a second transition region from the second outer flank into the circumferential surface has a varying curvature.

13. The gas turbine component as recited in claim 12 wherein the gas turbine element is an inner ring.

14. A stator vane cluster comprising the gas turbine component as recited in claim 1.

15. The stator vane cluster as recited in claim 13 wherein the gas turbine element is an inner ring.

16. A gas turbine subassembly having a gas turbine component as recited in claim 1 and the gas turbine element.

17. The gas turbine component as recited in claim 16 wherein the gas turbine element is an inner ring with a pin for spoke centering at the radial slot of the gas turbine component.

18. A gas turbine comprising the gas turbine component as recited in claim 1.

19. An aircraft engine gas turbine comprising the gas turbine as recited in claim 18.

20. The gas turbine component as recited in claim 2 wherein the gas turbine component includes five circumferentially spaced vanes and the middle of the gas turbine component at a middle vane of the five vanes and the radial slot is radially inner of a further of the five vanes adjacent to the middle vane.

* * * * *